United States Patent [19]

Hommani et al.

[11] Patent Number: 4,823,891

[45] Date of Patent: Apr. 25, 1989

[54] STABILIZER SLEEVE FOR DRILL STRING

[75] Inventors: Noureddine Hommani, Chenove; Daniel Kadjar, Vaucresson, both of France

[73] Assignee: TOTAL Compagnie Francaise des Petroles, Paris, France

[21] Appl. No.: 89,805

[22] Filed: Aug. 27, 1987

[30] Foreign Application Priority Data

Aug. 27, 1986 [FR] France ..... 86 12117

[51] Int. Cl.[4] ..... E21B 17/10; E21B 21/00

[52] U.S. Cl. ..... 175/323; 175/324; 175/325

[58] Field of Search ..... 175/325, 324, 323; 166/241

[56] References Cited

U.S. PATENT DOCUMENTS

| | | | |
|---|---|---|---|
| 1,616,666 | 2/1927 | Nebergall | 175/325 X |
| 1,721,004 | 7/1929 | Debose | 175/325 |
| 1,767,198 | 6/1930 | Baker | 175/325 X |
| 2,021,451 | 11/1935 | Johnson | 175/325 |
| 2,602,512 | 7/1952 | Baker | 175/325 X |
| 2,776,111 | 1/1957 | Vance | 175/325 |
| 4,583,603 | 4/1986 | Dorleans et al. | 175/324 |

FOREIGN PATENT DOCUMENTS

| | | | |
|---|---|---|---|
| 1155436 | 10/1983 | Canada | 175/325 |

*Primary Examiner*—Hoang C. Dang

*Attorney, Agent, or Firm*—Sughrue, Mion, Zinn, Macpeak and Seas

[57] ABSTRACT

A drill string stabilizer includes a cylindrical sleeve 11 coaxially surrounding a central tubular element 10 and fixed thereto by a plurality of helical blades 17 extending between the facing surfaces of the sleeve and the element. Converging truncated cones 13, 16 are provided on both ends of the sleeve. The upwardly flowing drilling mud establishes an annular fluid bearing between the sleeve and the borehole, while the helical blades implement a pumping function to enhance the discharge of the mud and cuttings.

5 Claims, 3 Drawing Sheets

STABILIZER SLEEVE FOR DRILL STRING

BACKGROUND OF THE INVENTION

This invention relates to a stabilizer sleeve fitting adapted to be serially mounted in a drill string to support such string in a borehole and to establish the position of the string in relation to the borehole axis, particularly in the case of deviated or angular drillings.

A drill string comprises a succession of hollow tubular elements having a drilling tool fitted to the lower end thereof. The drilling fluid or mud is pumped down through the string to the drilling tool or cutting bit to lubricate it, and carries the dislodged earth particles back up to the surface through the annular space between the drill string and the wall of the borehole.

To implement the upward flow of the drilling fluid across a conventional stabilizer, its outer wall is typically provided with a series of helical grooves. Such grooves determine, by their width and configuration, the hydrodynamic lift exerted laterally on the stabilizer. With conventional stabilizer constructions, however, it is difficult if not impossible to optimize the design of the outer wall of the stabilizer from the standpoints of both lift and the discharge of the drilling fluid. Such optimization is hampered during the design of the stabilizer due to the existence of the helical grooves, which makes it impossible to accurately calculate the hydrodynamic lift.

SUMMARY OF THE INVENTION

This invention enables such optimization by separating, from a design standpoint, the stabilizer parts which influence the lift of the assembly from those which facilitate the upward climb or discharge of the drilling fluid. To this end, the stabilizer of the invention includes a tubular element fitted at its opposite ends with connections to facilitate its serial coupling in a drill string, such tubular element being coaxially surrounded by a cylindrical sleeve whose outer wall is smooth. A plurality of helical blades are mounted between the tubular element and the inside of the sleeve to support the latter and to drive the drilling fluid upwardly through the annular space between the tubular element and the sleeve. The smooth outer wall or surface of the stabilizer enables the accurate calculation or determination of the lift that will be exerted on the stabilizer, and the pump effect derived from the helical blades facilitates the upward discharge of the drilling fluid.

According to a particular aspect of the invention, the cylindrical stabilizer sleeve is provided with converging truncated cones at both its upper and lower ends, which deflects some of the drilling fluid into the annular space between the sleeve and the wall of the borehole where it establishes a fluid bearing to enhance the stability of the drill string assembly.

The outer surface of the upper truncated cone is preferably reinforced with a coating of tungsten carbide to protect the stabilizer during its extraction from the borehole and to enable it to clear any obstructions by abrading the wall of the borehole.

A series of circumferentially spaced notches are also preferably provided around the base edges of both the upper and lower truncated cones to facilitate the introduction of the upwardly flowing drilling fluid into the annular passage surrounding the sleeve and its exit therefrom.

DETAILED DESCRIPTION OF THE PREFERRED EMBODIMENT

Figure 1:
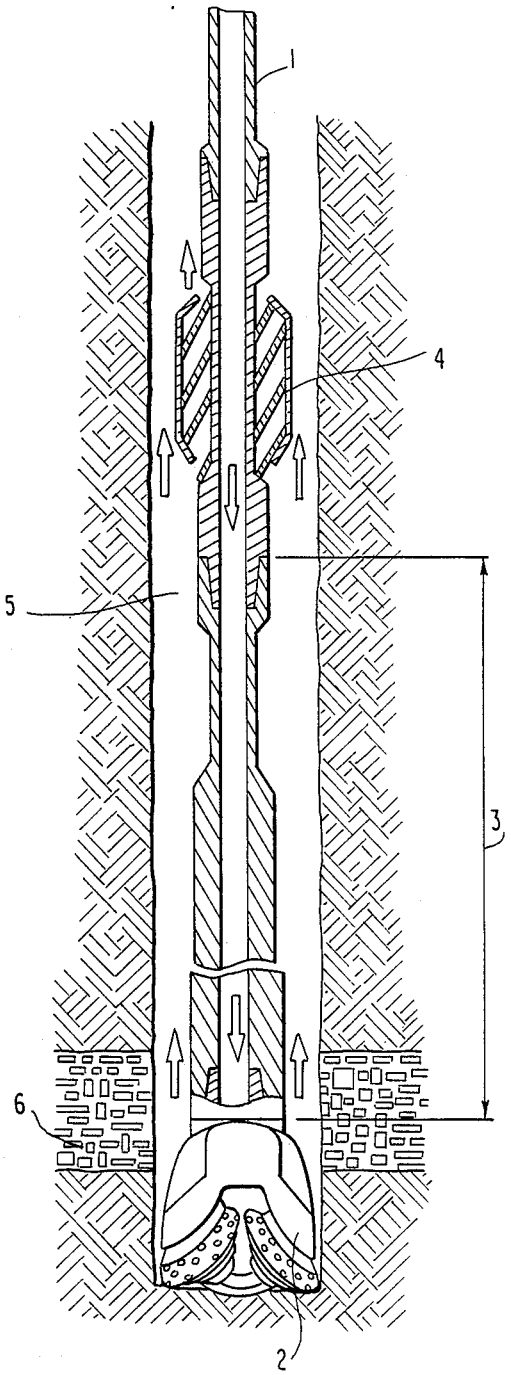
FIG. 1 shows an axial section through a drill string disposed in a borehole and fitted with a stabilizer according to the invention.

Referring to FIG. 1, a drill string 1 carries a cutter bit 2 at the lower end of an assembly of drill stems or tubes 3. A stabilizer 4 in accordance with the invention is serially coupled into the string above the assembly. The string is disposed in a borehole 5 being drilled in a formation 6.

Figure 2:
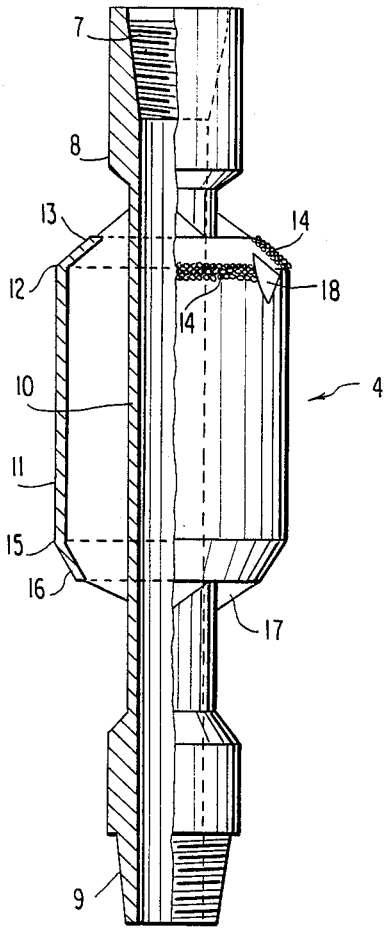
FIG. 2 shows a larger scale elevation of the stabilizer, partly in section.
Figure 3:
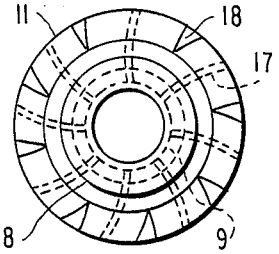
FIG. 3 shows a top or plan view of the stabilizer.

As shown in FIG. 2, the stabilizer 4 includes an upper female connector 7 provided in a fishing nose 8, a lower male connector 9, a central tubular element 10 extending between the two connectors, and a clindrical sleeve 11 coaxially surrounding the tubular element. The upper edge 12 of the sleeve is extended by a converging truncated cone 13 carrying a coating 14 of tungsten carbide or the like, and the lower edge 15 of the sleeve is similarly extended by a converging truncated cone 16.

Figure 4:
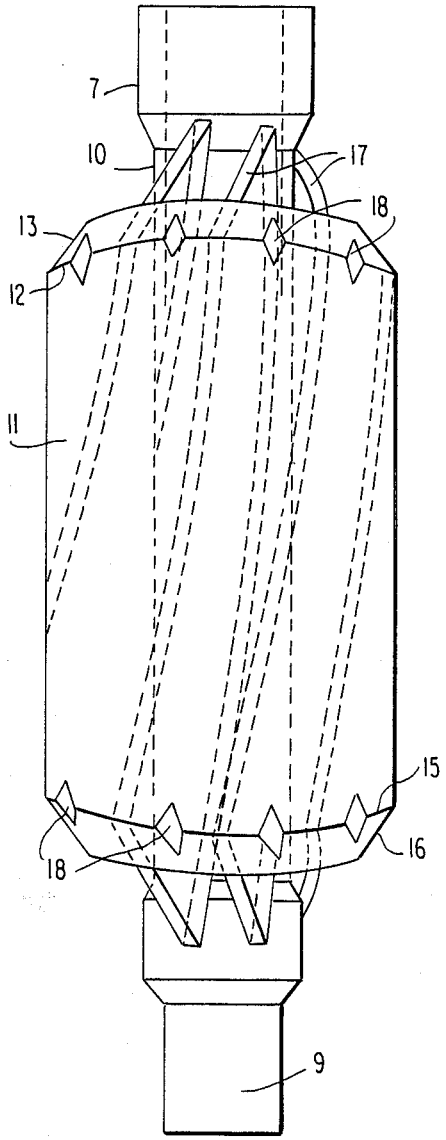
FIG. 4 shows a further enlarged elevation of the stabilizer.

A plurality of helically oriented blades 17, as best seen in FIG. 4, are welded between the outer wall of the tubular element 10 and the inner wall of the cylindrical sleeve 11.

Flow directing or facilitating notches 18 are provided around the upper and lower edges 12, 15 of the sleeve, between the zones whereat the blades 17 are affixed to the sleeve. The notches 18 may be comparatively shallow as shown, or they can penetrate through the entire thickness of the sleeve.

The stabilizer thus constructed displays a high degree of rigidity due to the thickness of the tubular element 10 and the sleeve 11, and the triangulating reinforcement provided by the helical blades 17.

A portion of the upwardly flowing drilling fluid is deflected outwardly by the lower truncated cone 16 converging inwardly from the bottom of the cylindrical sleeve 11, and passes through the annular space between the outer surface of the sleeve and the wall of the borehole to create a fluid bearing effect. Such bearing effect controls the lift exerted on the outer wall of the stabilizer and establishes a fluidic cushion or buffer which prevents any direct contact between the stabilizer and the borehole. The attendant absence of any contact friction reduces azimuth deviations of the borehole, and improves the transmission of the driving force to the cutter bit.

In a rotary drilling installation incorporating a single stabilizer in accordance with the invention, the load loss or pressure drop across the stabilizer is reduced by more than 1 bar as contrasted with the drop across a conventional stabilizer. For a drill string fitted with four stabilizers of the invention, the pressure gain or load loss reduction is about 5 bars. Thus, by utilizing stabilizers in accordance with the invention the surface pressure applied to the drilling fluid being pumped downwardly can be significantly reduced, while still enhancing the upflowing discharge of the cuttings. In turbodrilling, during which the stabilizer rotates at about 800 rpm, the pumping function implemented by the helical blades is especially significant and a distinct improvement of the drilling rate can be obtained.

What is claimed is:

1. A drilling apparatus comprising, in combination, an elongate drill string (1), a cutter bit (2) mounted to a lower end of the string, and a stabilizer (4) serially connected in the string and spaced from the cutter bit, wherein the stabilizer comprises:

(a) an elongate tubular element (10) having connector means (7, 9) at opposite ends thereof for serially coupling into the drill string for rotation therewith, said tubular element being hollow to enable the descending flow of a drilling fluid during the rotation of the drill string and cutter bit, (b) a cylindrical sleeve (11) disposed coaxially surrounding the tubular element and being secured thereto by, (c) a plurality of circumferentially spaced, helically oriented blades (17) extending between and fixedly secured to an outer surface of the tubular element and an inner surface of the sleeve such that the sleeve rotates together with the tubular element, (d) the sleeve having a smooth outer surface and an outer diameter sufficiently smaller than the outer diameter of the cutter bit to define an annular space between said outer surface and a surrounding wall of a borehole (5) drilled by said cutter bit to implement the establishment of an annular fluid bearing by drilling fluid flowing upwardly through said annular space, and the blades implementing a pumping function to enhance the upward discharge flow of the drilling fluid and entrained cuttings, and (e) said sleeve having an inwardly converging, truncated conical member (16) extending axially from a lower edge (15) of the sleeve and serving to deflect a portion of the upwardly flowing drilling fluid outwardly to enhance the establishment of the fluid bearing.

2. The drilling apparatus according to claim 1, further comprising an inwardly converging, truncated conical member (13) extending axially from an upper edge (12) of the sleeve.

3. The drilling apparatus according to claim 2, further comprising a layer of tungsten carbide (14) covering the outer surface of the upper one of said conical members and overlapping the upper edge of the sleeve.

4. The drilling apparatus according to claim 2, further comprising a plurality of flow distributing notches (18) circumferentially spaced around and formed in one of the upper and lower sleeve edges, in zones between the blades.

5. The drilling apparatus according to claim 3, further comprising a plurality of flow distributing notches (18) circumferentially spaced around and formed in one of the upper and lower sleeve edges, in zones between the blades.

* * * * *